United States Patent [19]

Kuipers

[11] 4,421,499

[45] * Dec. 20, 1983

[54] TUBE FORMING SHOE AND METHOD OF FORMING A FLEXIBLE WEB INTO A SHOE

[75] Inventor: Peter Kuipers, Taylors, S.C.

[73] Assignee: Nordson Corporation, Amherst, Ohio

[ * ] Notice: The portion of the term of this patent subsequent to Oct. 20, 1998 has been disclaimed.

[21] Appl. No.: 285,435

[22] Filed: Jul. 20, 1981

Related U.S. Application Data

[63] Continuation of Ser. No. 85,044, Oct. 15, 1979, Pat. No. 4,295,322.

[51] Int. Cl.[3] ..... B31B 1/38

[52] U.S. Cl. ..... 493/23; 226/18; 493/20; 493/248; 493/302

[58] Field of Search ..... 493/302, 20, 8, 23, 493/248; 53/51, 551, 552, 550; 226/18, 15

[56] References Cited

U.S. PATENT DOCUMENTS

| | | | |
|---|---|---|---|
| 2,821,387 | 1/1958 | Faeber | 226/3 |
| 2,951,322 | 9/1960 | Wood | 53/28 |
| 3,042,103 | 7/1962 | McDevitt et al. | 156/466 |
| 3,267,822 | 8/1966 | Harrison | 93/82 |
| 3,285,446 | 11/1966 | Strickland | 226/3 X |
| 3,296,770 | 1/1967 | Wilson | 53/182 |
| 3,370,517 | 2/1968 | Vichos | 93/82 |
| 3,381,442 | 5/1968 | Paxton | 53/28 |
| 3,415,171 | 12/1968 | Wilson | 493/302 |
| 3,432,980 | 3/1969 | Seiferth et al. | 53/14 |
| 3,486,424 | 10/1969 | Tanner | 93/82 |
| 3,494,265 | 2/1970 | Middour | 93/82 |
| 3,636,826 | 1/1972 | Bowen et al. | 93/59 R |
| 3,680,446 | 8/1972 | James et al. | 93/82 |
| 3,962,958 | 6/1976 | Hobart | 93/20 |
| 4,009,551 | 3/1977 | Greenawalt et al. | 53/28 |
| 4,074,504 | 2/1978 | Greenawalt et al. | 53/22 A |
| 4,084,999 | 4/1978 | Rucker | 93/20 |
| 4,090,432 | 5/1978 | Hobart | 493/20 |
| 4,144,693 | 3/1979 | Ogata | 53/433 |

FOREIGN PATENT DOCUMENTS

| | | |
|---|---|---|
| 810849 | 3/1959 | United Kingdom . |
| 954517 | 1/1963 | United Kingdom . |
| 1557480 | 12/1979 | United Kingdom . |

*Primary Examiner*—James F. Coan

*Attorney, Agent, or Firm*—Wood, Herron & Evans

[57] ABSTRACT

An improved film tube forming shoe includes a brake edge having a configuration which is related to the diameter of the shoe, to the film width, and to the diameter of a product to be wrapped in the tube. The shoe is provided with outwardly directed pressurized fluid ports in the brake edge to provide an air cushion for the film as it is drawn through an acute angle around the brake edge into the shoe. The fluid also cleans the edge and reduces accumulation of foreign matter thereon. To promote accurate film tracking through the shoe, it is rotatable in response to changes in the position of an edge of the film before it enters the shoe. Methods are provided for forming the shoe, and brake edge, without trial and error, for wrapping products of known diameter, and for wrapping articles.

8 Claims, 5 Drawing Figures

TUBE FORMING SHOE AND METHOD OF FORMING A FLEXIBLE WEB INTO A SHOE

This is a continuation of application Ser. No. 85,044 filed Oct. 15, 1979 now U.S. Pat. No. 4,295,322.

This invention relates to tube formers and forming and particularly to apparatus and method for forming a flexible flat web into a tube.

Elongated articles such as candy sticks or rolls of wallpaper, have previously been packaged in plastic film which is wrapped around the articles. A flat plastic film is supplied from a roll of film and is guided into a tubular shape around the moving candy, for example, by a tube-shaped forming shoe. Typically, the plastic film is directed into the shoe through an acute angle from a position radially spaced from the shoe, and around a fold or brake edge thereof. In the shoe, the tube envelops the candy. As the now tubular film exits the shoe, overlapped edges of the film are sealed to form a longitudinal seam. Thereafter, the tube is cut between adjacent articles and the ends are sealed to form individual packages. In some cases the film tube is then heat shrunk around the article. In this operation, then, the plastic film is manipulated from a flat rolled film on the supply roll into a seamed tube about an article.

One critical area in this operation is the transitional area along the leading edge of the tubular forming shoe and at which the film turns into the tube and is guided into a tubular orientation. Such edge is typically referred to as the leading edge, entry edge, brake edge or folding edge of the shoe former.

It is necessary that the shape of the brake edge of the forming shoe be exactly formed to insure a smooth, uniform, efficient and operable film transition. If the shape of the brake edge is not proper, then excessive tensions are generated in the film near its center or near its edges. Such uneven tensions cause the film to "wander" in relation to the shoe and seaming apparatus, preventing a uniform seam overlap. Also, uneven tension can cause the film to be stretched or deformed which prevents formation of a uniform seam and of a useful package.

In the past, design of the forming shoe has largely been premised on a hit and miss or trial and error basis. The leading edge either worked or not, and unfit shoes had to be reshaped or scrapped.

Moreover, the characteristics of the particular film run through the former shoe tended to cause the film to wander. For example, the gauge, lay flat and camber characteristics of a particular film cause it to wander, particularly where the forming shoe brake edge was not properly oriented. Different brake edge configurations then were required to prevent excessive film wander and to promote uniform tube forming. Despite the brake edge configuration, without the exactly proper orientation of the entire former, the film does not track accurately and the desired uniformity of the longitudinal seam is not achieved. These varying film characteristics have made it very difficult to produce a forming shoe with an appropriate edge shape and orientation capable of uniformly forming a useful tube. Thus it has been difficult to manufacture useful forming shoes to form tubes about articles of known predetermined dimensions.

Apart from the shape and orientation of the forming shoe, and its brake edge, a further difficulty in such a tube forming operation has to do with the nature of the product about which the tube is formed. In an operation for packaging candy sticks such as straight, hard peppermint candy canes, for example, candy dust and chips are carried into the atmosphere and are deposited onto the forming shoe. Such deposits are particularly harmful when located on the film brake edge of the shoe. They tend to stick to the film or to drag on the film, upsetting the smooth transition into a tube form. It can cause excessive film tensions and "wander," leading to non-uniform longitudinal seams, and to other undesirable operational and product characteristics. Moreover, such particles can score the film as it is pulled through the former and around the brake edge.

Also, it has been noted that the continued pulling of film around an edge of a former can wear the edge, changing its configuration or requiring a new former shoe. While the solution of wear inserts has been proposed to remedy this, wear parts are required and these are still subject to deposits of foreign matter as described above.

Accordingly, it has been one objective of this invention to provide an improved tube forming shoe.

A further objective of the invention has been to provide an improved method of making a forming shoe for forming tubes from a flexible web.

A further objective of the invention has been to provide improved methods for forming tubes from flexible webs.

A further objective of the invention has been to provide apparatus for controlling the orientation of a tube forming shoe for handling films of differing characteristics.

A further objective of the invention has been to provide improved apparatus and methods for controlling the accurate tracking of the film through a tube forming shoe.

A further objective of the invention has been to provide an improved forming shoe which prevents undesirable foreign particle accumulation and film dragging on the film engaging edges of the shoe.

A still further objective of the invention has been to provide a method for preventing undesirable accumulation of foreign matter on the film engaging and guiding edge of a tube forming shoe.

A further objective of the invention has been to provide an improved, self-cleaning film supporting tube forming shoe.

To these ends, a preferred embodiment of the invention includes an improved tube forming shoe which includes a film brake edge having outwardly directed ports for directing pressurized fliuid such as compressed air onto the film at the edge. This exhausting air forms an air cushion or bearing which both supports the film away from substantially the entire edge, reducing film drag and shoe wear, and at the same time cleans the edge and prevents accumulation or deposit of undesirable foreign matter on the edge.

In another aspect of the invention, the shoe has a leading or film brake edge of a particular configuration relating directly to the diameter of the product to be wrapped. Knowing that diameter, a shoe can be manufactured, according to the invention, without trial and error, for smoothly and accurately forming the tube for wrapping the product. Stated in another way, the brake edge has a configuration which is directly related to the interior diameter of the tube forming shoe. This configuration correctly accepts and causes proper film folding, as the film goes through its transition from flat to tube form, without unduly stretching, deforming, creasing or otherwise harming the film or impeding the operation. Stated in yet another way, the configuration of the brake edge is directly related to the width of the film which is to be handled.

In still another aspect of the invention, the forming shoe is rotationally mounted about its longitudinal axis and can be rotationally adjusted to control accurate film tracking through the shoe. This provides an improved uniformity of film overlap for accurate seaming.

In the preferred embodiment, a film edge position sensor is operatively disposed proximate an edge of the film just prior to the film's entering the shoe. Changes in the position of the film's edge are sensed by a control apparatus which generates signals to control motive means for rotating the shoe responsive to the position changes.

Thus the preferred embodiment of the invention provides an improved tube forming shoe having an air bearing for supporting the film at its fold area and for cleaning the brake edge area, a particular brake edge design for uniformly handling films without undesirable deformation or tracking, and the capability of true film tracking control. Not only is the forming shoe and the tube forming method improved, but knowing the product diameter, a useful forming shoe can be manufactured according to the invention without trial and error.

These and other objects and advantages will become readily apparent from the following description of a preferred embodiment of the invention and from the drawings in which.

Figures 1, 2, 3:
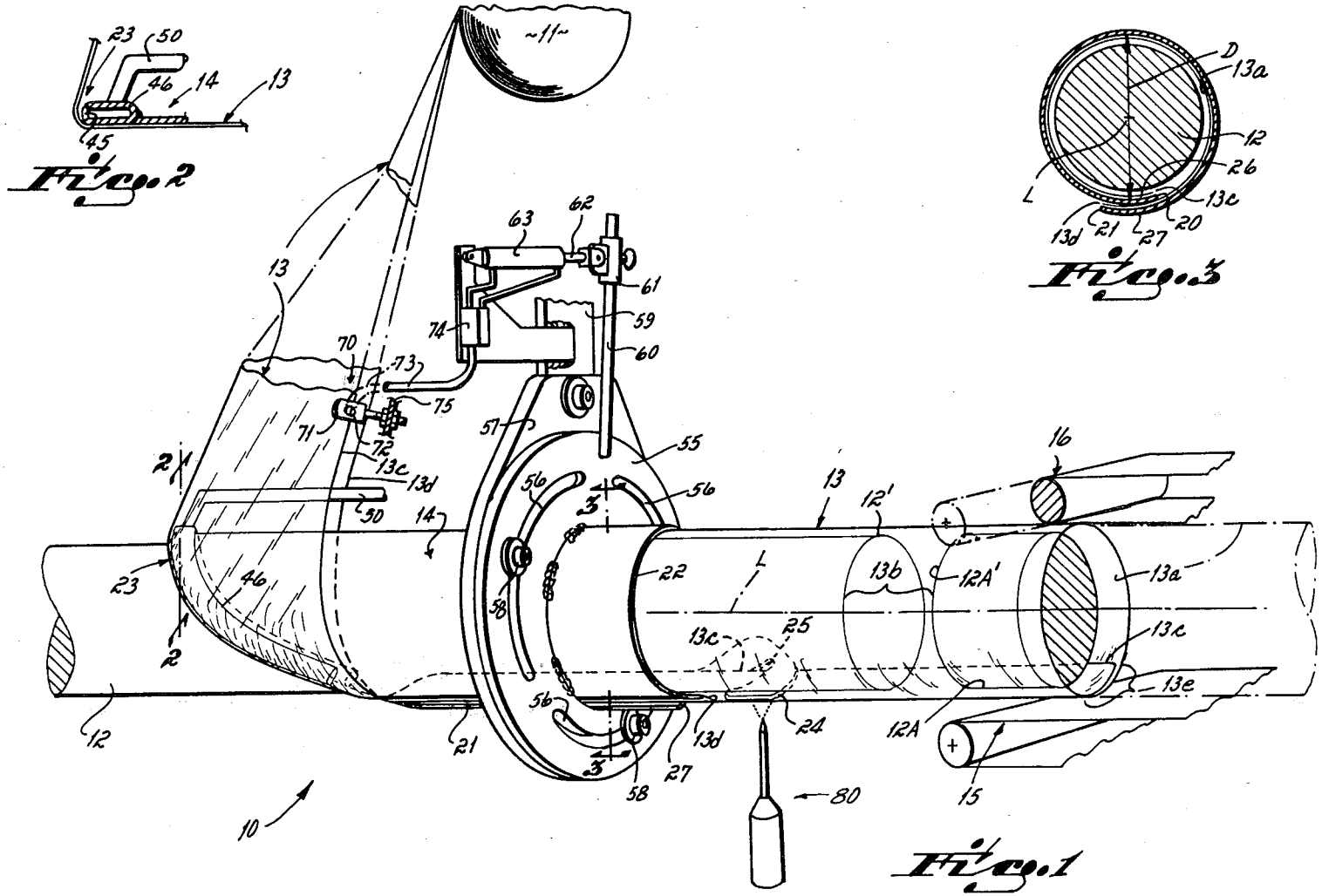
FIG. 1 is an overall perspective view of a preferred embodiment of the invention.
FIG. 2 is a cross-sectional view taken along lines 2—2 of FIG. 1.
FIG. 3 is a cross-sectional view taken along lines 3—3 of FIG. 1.

Turning now to the drawings, there is shown in FIG. 1 thereof a preferred embodiment of the invention 10 including tube forming apparatus for forming an elongated flat web into a tubular configuration. This embodiment is particularly useful for wrapping cylindrical elongated articles such as candy sticks, rolls of wallpaper and the like within a packaging or protective film.

As shown in FIG. 1, a web or film supply 11 is generally disposed above the preferred embodiment 10. The film supply may include a roll of flat film and film feeding rollers, but only the film roll is shown in FIG. 1 for clarity. While the invention may be used to transform flat webs of many different kinds of materials into tubular form (such as plastics, papers and foils) the preferred embodiment will be specifically described with respect to an elongated flat web of plastic film typically utilized to wrap elongated articles 12 such as sticks of candy, for example.

Generally, the film supply 11 is unrolled to provide an elongated film 13 of thin plastic material on the order of mils. Such plastic film can be any suitable plastic packaging or protective film, for example, and may be of the heat shrinkable variety.

The film 13 is directed downwardly where it enters a tube-shaped forming shoe 14. As the film web 13 enters the shoe, the shoe guides it into a tubular shape and wraps it around the elongated article 12.

The film 13, as it approaches and turns into the shoe, forms an acute included angle with respect to itself (FIGS. 1 and 2). In other words, as seen in FIG. 1, the film supply 11 is disposed rearwardly of that point of the forming shoe 14 where the film enters the shoe. As the film enters the shoe it is folded or bent around a leading edge of the shoe 14 and is then guided into the tubular configuration it takes on such as at 13*a*, for example.

When formed into a tube, the film edges 13*c* and 13*d* are overlapped to form an elongated seam 13*e* along the film tube. For products in the range of two inches in diameter, for example, such seam may be one-half to three-fourths inch wide.

Both the article and the film are pulled through the shoe 12 in the directions of the indicating arrows by means of conveyors 15 and 16 located below and above the wrapped articles. Conveyors 15 and 16 are spaced so they engage the upper and lower sides of the wrapped articles and pull them along, thus drawing the film 13 and the articles therein through the shoe. Other film pulling or pull-down apparatus could be used if desired, particularly where the formation of an unfilled tube is desired.

Separate elongated articles 12 and 12A are slightly separated within the film as it emerges in tubular form such as shown at 13*a*. Article 12 has a leading end 12', while article 12A has a trailing end 12A'. These are separated to provide for an excess of tube material 13*b* which can be cut and sealed to close off the ends of the tube in a downstream operation, for example. Finally, with respect to FIG. 1 it will be appreciated that in the embodiment illustrated, the film 13 does not end between the conveyors 15 and 16 but is continuous as shown in phantom about a plurality of articles for latter cutting, sealing, and perhaps heat shrinking of the film wrap.

Figure 4:
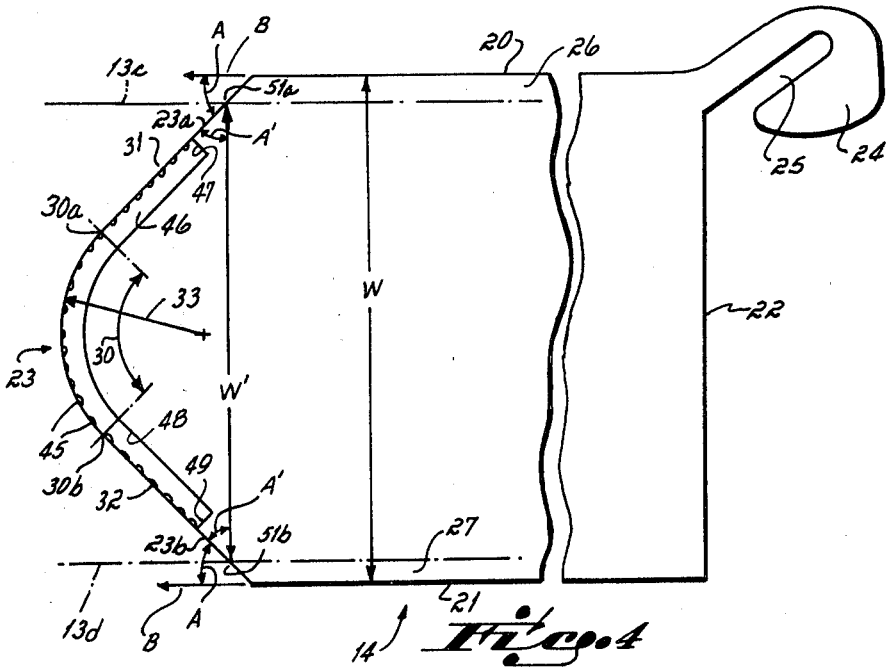
FIG. 4 is a view of the developed forming shoe and air tube of FIG. 1.
Figure 5:
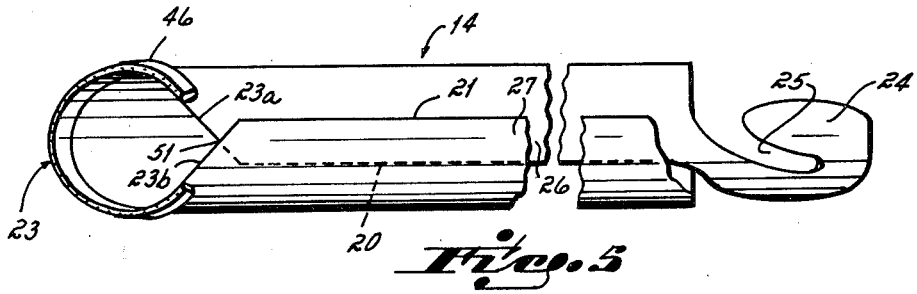
FIG. 5 is a bottom view of the forming shoe of FIG. 1, omitting the collar and shoe support.

Turning now to the details of the forming shoe 14, it is depicted in its operational form in FIGS. 1 and 5 and in its developed form in FIG. 4. Its developed form as in FIG. 4 shows the tubular shaped shoe 14 developed in a flat plane.

As shown in FIG. 1, and more particularly in FIG. 4, the shoe 14 is preferably made from relatively thin material such as sheet metal. The shoe 14 has spaced parallel sides 20 and 21, a trailing or outlet edge 22 and a leading edge or film brake edge 23. Near side edge 20, and depending from the trailing edge 22, the shoe 14 includes a sealing foot 24 in the form of a hook-shaped element provided by the film receiving slot 25 as will be further described. Of course, it is not necessary for sides 20, 21 to be parallel, and other side configurations could be used.

Leading edge or brake edge 23 is that portion of the shoe over which the film 13 is first drawn as it enters the shoe as shown in FIG. 1. The configuration of this edge is critical to the smooth and efficient transition of the film into its tubular condition.

In the formation of tube forming shoes it has previously been very difficult to provide a brake edge 23 with the particular type of configuration required in order to maintain the film in a smooth condition as it passed over the brake edge 23 and was guided into a tubular form. Improper configurations for the brake edge 23 could result in undesirable deformation, crinkling or creasing of the film, and in non-uniform film tensions causing film tracking difficulties.

The invention contemplates a particular configuration of the brake edge 23. Referring particularly to the developed view of FIG. 4, the brake edge 23 includes a central curved portion 30 and respective straight portions 31 and 32 which extend from the curved portion on opposite sides thereof to the respective sides 20 and 21 of the forming shoe 14. More particularly, the curved portion is located centrally of the edges 20 and 21 and the straight portions 31 and 32 engage the curved portion tangentially and then extend rearwardly from respective sides of the curved portion 30 to the sides 20 and 21. The straight portions 31 and 32 extend from tangent the curved portion 30 toward the sides and form an angle A on each side of approximately 45° with the direction of extension B of each of the sides 20 and 21 where those sides are parallel. While this angle may slightly vary, it is believed important to maintain it within one-half degree of 45°. Whether or not the sides 20, 21 are parallel, the angle A′ of the straight portions is 45° with respect to a reference line drawn between points on the straight portions, which points are equidistant from the end points of the curved portion, i.e. the points of the tangent intersection between the curved portion and the respective straight portions. See for example the reference arrow line W′.

The central curved portion 30 has a particular radius 33. In the preferred embodiment, the radius is substantially equal to the diameter D of the forming shoe 14 when it is in the tubular form as shown in FIGS. 1, 3 and 5.

The forming shoe 14, having a diameter D as shown in FIG. 3, is useful for forming a tube of plastic around a specific elongated article which has a diameter slightly less than the diameter D. For example, a shoe 14 having a diameter D is suitable for wrapping articles having a diameter which is about one-fourth to three-eighths inch less than that of diameter D. This provides clearance for the elongated article and for the film as they move through the shoe 14.

Accordingly, then, it will be appreciated that the radius 33 is approximately equal to the diameter D of the forming shoe 14. Preferably, the radius 33 should be kept within plus or minus one-sixteenth inch of the final shoe diameter D, although greater variations might be acceptable for specific types of film. It is believed that most variations must be kept within this range in order to provide the desirable smoothness of the film as it makes the transition from its flat condition to the tubular configuration 13*a* (FIG. 1).

Turning specifically to FIG. 3, it will be appreciated that the diameter D is that interior diameter which extends between the bottom of the shoe 14 through the center longitudinal axis L, of the shoe, to the top of the shoe 14. In its tubular shape, the shoe has an overlapping portion of approximately one-half to three-fourths inch. Thus, as shown in FIG. 3, the shoe 14 has overlapped portions 26 and 27, each of which is approximately one-half to three-fourths inch long to provide for corresponding film overlap.

In the manufacture of shoe 14, then, it is desirable to maintain the diameter D consistent throughout as much of the shoe as possible. Accordingly, the diameter D may hold consistently through about three-fourths of the extension of the shoe 14 and then toward the overlapped portion 27, the diameter slightly increases as that portion is widened out to overlap the portion 26 as shown in FIG. 3. Nevertheless, the critical diameter D as shown in vertical position in FIG. 3 is that diameter to which the radius 33 of the curved portion 30 of the brake edge 23 is directly related.

Of course, it should be appreciated that while the forming shoe 14 is capable of handling products which happen to have a slightly lesser diameter than the diameter of the forming shoe, it is also possible to construct a forming shoe, according to the invention, to handle varied products having different diameters. Accordingly, in another aspect of this invention, the forming shoe is constructed with a direct relationship to the particular diameter of the elongated product to be packaged.

For example, in the packing of an elongated candy stick having a diameter of two inches, it is desirable to have a forming shoe of a diameter of approximately one-fourth to three-eighths inch greater than that of the elongated article. The diameter D of the forming shoe would then be selected, for example, to be two and one-fourth inches. Accordingly, the radius 33 of the curved portion 30 of the brake edge 23 would be approximately two and one-fourth inches.

Finally, the width W of the forming shoe in its developed plan view (FIG. 4) will be equal to the width of the film desired to wrap around the elongated product. More particularly, that W dimension would, in this example, then be selected equal to the interior circumference of a former shoe 14, having a diameter D equal to about two and one-fourth inches, plus approximately one inch to permit an approximate one-half inch overlap of the film in order to form a longitudinal seam therein. The film selected to use in such a former would also have a flat width E equal to that of the former. Thus it has been found suitable, for example, to provide a forming shoe having a diameter D equal to about two and one-fourth inches for utilization to envelop an elongated product having a diameter of about two inches. In this regard, the particular film selected has a width which is approximately equal to the interior circumference of the former having a diameter D, plus approximately one inch in order to provide for the overlap of the film such as shown in FIGS. 1 and 3. The total width of the forming shoe, then, when developed in the flat plane such as shown in FIG. 4 is equal to the width of the film which has been so selected. Both of these dimensions are also thus directly related to the radius 33 according to this invention.

Accordingly, for an elongated product of known diameter such as sticks of candy, tubes of wallpaper, posters or other elongated articles, the invention contemplates the manufacture of a forming shoe 14 for enveloping such articles in a plastic film tube whereby the forming shoe is particularly constructed in relation to the articles being enveloped in the tube so as to provide a smooth film transition from the film supply into the tube without creasing, deformation or other problems generated by uneven film tensions as it makes the transition from its flat configuration into its tubular configuration.

Continuing now with the description of the forming shoe, it will be appreciated that as the film engages the forward edge of the shoe it slides around the forward brake edge 23 and is then drawn into the tube and into its tubular configuration. In many operations and particularly, for example, where candy is involved, foreign particles such as candy dust deposit on the forward edge and brake edge of the forming shoe. These deposits cause the film to drag and cause uneven tensions across the film as it is pulled across the brake edge 23.

Moreover, and in a humid atmosphere, the deposits become sticky and the film dragging and tension problem is further compounded. Such uneven dragging and tension causes the film to wander across the brake edge 23 of the shoe. Such film wander causes uneven film edge overlap when the film gets to the seam sealing area, as will be described, and thus results in non-uniform seams and in non-uniform tubes around the article.

This problem has been solved, according to the invention, by providing brake edge 23 with a plurality of pressurized fluid ports 45 which are directed outwardly of the brake edge 23. A typical port 45 is shown in FIG. 2 and the orientation of the plurality of ports 45 is shown in FIG. 4 where the forming shoe is shown developed into a flat plane.

In operation, pressurized fluid such as compressed air is exhausted through the ports 45. These ports 45 generate an air cushion or air bearing, between the film 13 and edge 23 (FIG. 2) which holds the film away from the brake edge 23 as it is bent there around. Thus the film never actually engages the brake edge 23, but rather is carried around the brake edge by an air cushion which conforms in shape to the configuration of the brake edge of the shoe 14. Thereafter, the film slides along the interior surface of the tubular forming shoe 14.

More particularly, the ports 45 are located in a tube 46 which constitutes and defines a portion of the brake edge 23. Tube 46 is an elongated tube which is drilled to provide for the ports 45, flattened into the shape shown in FIG. 2, and then welded to the edge of the tubular forming shoe 14. Tube 46 extends about three-fourths the distance around the brake edge 23.

To accommodate the tube 46, the shoe 14 is relieved as at 47, 48 and 49 (FIG. 4) so that the bent tube can be inserted into the shoe 14. Thus, in FIG. 4 it will be appreciated that the forward edge of the tube defines a portion of the brake edge 23, and further that a portion of the brake edge 23, such as noted at 23*a* and 23*b* is also defined by the forward edge of the actual shoe 14. Thus, the edges 23*a* and 23*b* are a continuation of the respective straight portions 31 and 32 of the brake edge 23 as defined by the tube 46. To supply the tube 46 with compressed air, a pipe or conduit 50 is attached thereto and extends to a source of compressed air (not shown). Of course, the ends of tube 46 are sealed off.

Once the tube has been welded onto the forming shoe 14 as shown in FIG. 4, the whole shoe is then rolled to form the tubular forming shoe 14 as shown in FIGS. 1 and 5. As shown in FIG. 5, the forming shoe 14 is rolled so that its side portions 26 and 27 overlap. In this view, edges 23*a* and 23*b* are clearly shown overlapping at point 51. Corresponding overlap points 51*a* and 51*b* are shown in the developed view of FIG. 4 for clarity. In FIG. 4, the width W′ between these points corresponds to the width W of the former 14, less the total amount of overlap, such as one-half inch. Also, points 51*a* and 51*b* are preferably equidistant from the ends 30*a* and 30*b* of the curved portion 30.

As seen in FIG. 1 and as more particularly described with respect to FIG. 4, the film 13 engages the brake edge 23 throughout the extent of the tube 14 and further onto the brake edges 23*a* and 23*b* of the forming shoe around to the overlap or intersection 51. Thus, the film 13 extends across the brake edge 23 of the forming shoe to a position short of the width W of the shoe, and the ports 45 and tube 46 extend along brake edge 23 substantially but not fully throughout the extent of the film along edge 23. Of course, it will be appreciated that the distance W′ between the points of intersection of the edges of film 13 with the edges 23*a* and 23*b* is not actually equal to the full width of the film in its completely developed flat configuration and that the edges of the film 13 are simply shown in FIG. 4 to illustrate the position at which the edges of the film engage and cross over the leading brake edges 23*a* and 23*b* of the forming shoe when the shoe is in its tubular configuration such as shown in FIG. 1. This difference is explained by the fact that as the film 13 engages the brake edge 23, the line of engagement of the film with the brake edge is not a straight line across the film but is rather a line which generally conforms to the configuration of the brake edge 23. Of course, as the film crosses the brake edge 23 of the forming shoe it is drawn into the shoe so that the edges of the film overlap to provide the seam as shown in FIG. 1. Such overlap, before the edges are brought together and are sealed, is shown in FIG. 3. In this connection then, it will be appreciated that the actual dimension W′ between the points where the film edges cross the edges 23*a* and 23*b* is approximately equal not only to the width of the former, less about one-half inch, but also to the width of the film less about one-half inch for accommodation of the seam overlap.

Turning now to a further description of the forming shoe 14, it includes a ring or collar 55 (not shown in FIG. 5) which is welded to the forming shoe 14 and which is provided with a plurality of arcuate slots 56 for mounting the forming shoe onto the bracket 57 by means of studs or bolts 58. In the preferred embodiment, the studs or bolts 58 are not tightened against collar 55, but permit selective rotation of the collar 55 in the shoe 14 about the longitudinal axis L of the former.

Of course, the bracket 57 is mounted to a frame member 59 of the apparatus for wrapping the elongated articles as will be appreciated. Further, bracket 57 includes a bore (not shown) through which shoe 14 extends.

An actuating arm 60 is welded onto the ring 55 and is connected by means of an adjustable sleeve 61 to the extensible shaft 62 of a double acting fluid cylinder 63. Fluid cylinder 63 is connected to means for sensing the position of the film 13 and for controlling the cylinder to extend its shaft 62 to rotate the collar 55. Such movement rotates the shoe 14 to adjust the shoe as the film moves through it and thus keeps the film oriented and tracking propeerly with respect to the shoe and the seaming area.

More particularly, the film edge 13*c* is sensed or monitored by a sensing apparatus 70, such as a vacuum sensor. In thir regard, the vacuum sensor comprises a forked sensing apparatus having a blade 71 with a port 72 therein. Port 72 is connected by a hose 73 to a control means 74. The sensing apparatus 70 is conveniently mounted on a frame member 75 of the tube forming apparatus.

The vacuum sensing apparatus 70 and control means 74 may be of any convenient type of which many are currently commercially available. Basically, these known sensing and control means work by virtue of sensing a film moving across the vacuum port 72. In this connection, the control apparatus 74 is operable to sense changes in the magnitude of coverage of the port 72 by the film 13. The apparatus is controlled to be in an equilibrium state when the film edge 13*c* extends across the port 72 so as to cover half of the port and leave the other half of the port open. If the film edge 13*c* moves so as to close or open the port, the control apparatus 74 senses this change and converts the change in the sensed pressure to a control signal for operating the cylinder 63 and thus rotating the collar 55 and shoe 14.

Accordingly, and for example, if the film edge 13*c* moves from the position shown in FIG. 1 to cover the port 72, the change in the pressure across the port 72 is sensed by the control means 74 which in turn controls the cylinder 63 to rotate the shaft 60 and thus the collar 55 and tube 14 in a counterclockwise direction as viewed in FIG. 1. This rotates the near side of the shoe 14, as viewed in FIG. 1, downwardly and thus adjusts the position of the brake edge 23 in relation to the film 13 as it enters the shoe 14. This slight adjustment serves to recenter the film in the shoe in an appropriate position. As the film edge moves back across uncovering the ports 72, this change is also sensed by the control means 74 and the cylinder 63 is signalled accordingly to rotate the shoe 14 in the opposite direction until the equilibrium stage is reached. Of course, if the film edge 13*c* moves so as to uncover the port 72, this change is also sensed by the control means 74 and the cylinder 63 is operated to move the arm 60, thus rotating the collar 55 and shoe 14 in a clockwise direction as viewed in FIG. 1 to adjust the shoe 14 with respect to the film and to get the film in its appropriate position. Thus, during an operation of forming a tube around an elongated article 12, rotation of the film shoe 14 is more or less a constant operation with the shoe rotating very slightly in various directions in order to maintain the appropriate position of the film in the film scene within the shoe 14.

It will be appreciated that the adjustable sleeve 61 can be adjustably positioned on the shaft 60 such that the tube 14 is rotated in larger or smaller increments in response to a change in the position of the film edge 13*c*. Thus, it will be appreciated that if a sleeve 61 is moved toward the collar 55 on the arm 60, the increments of rotation of the tube will be smaller. If the sleeve 61 is moved outwardly on the arm 60, the increments of rotation of the tube 14 will be larger, all in response to the same change of position of the film edge 13*c*. Thus, the tube forming shoe 14 by means of the sensing means, the control means and the motive means provided by the cylinder 63 can be adjusted to handle various kinds of film in order to maintain the film in a proper orientation as it moves through the tube despite slight changes in film tension and the like as the film is drawn through the tube.

After entering the forming shoe 14 and being formed into a tube around the elongated product 12, the tubular plastic film exits the tube 14 at the trailing end 22 and is seamed by sealing means 80, such as an electrical charge sealer of any known configuration and operation. In this regard, the film is overlapped and brought together for sealing by means of the slot 25 in the sealing foot 24. The inner overlapping film edge 13*c* is drawn through the slot 25 and beneath the sealing foot 24. Of course, since the sealing foot 24 trails from the shoe 14, and particularly the edge 20 thereof, the sealing foot 24 is located interiorly of the plastic film. After the film edge portion 13*c* passes through the slot 25 of the sealing foot 24, it engages the outer overlap portion 13*d* of the film and both films slide together over the sealing foot 24 and are sealed by the electric charge sealer 80.

Accordingly, it will be appreciated that the invention provides an improved tubular forming shoe wherein the film does not engage the brake edge but is held therefrom by means of an air cushion or air bearing. This reduces film tension as the film moves across and around brake edge 23 and at the same time prevents accumulation of foreign matter on the brake edge which would tend to cause uneven tensions in the film. As well, it reduces wear of the brake edge.

Moreover, the shoe is rotatable in response to the change in position of the film thus serving to accurately position the film within the shoe and particularly the overlapped portions 13*c* and 13*d* of the film as they move through the sealing area under the sealing foot 24 so that a uniform elongated seam is provided in the tubular film.

Also, the invention provides for the construction of a forming shoe having a particularly defined and configured brake edge which directly corresponds to the diameter of elongated articles which are to be wrapped. Thus, while a particular forming shoe is operable to handle articles of the slightly less diameter according to the invention, the invention also provides methods by which a forming shoe can be provided with a particular brake edge for handling films to envelop elongated articles of any known diameter. Trial and error construction of a forming shoe is not required. The brake edge of the forming shoe is particularly configured to provide a smooth transition in the film from the film supply into its tubular form, without undue tensioning or tracking problems and all while providing a uniform, elongated seam in the tubular film which is formed about the article.

Having described the preferred embodiment of the invention, other modifications and variations will be readily appreciated by those of ordinary skill in the art without departing from the scope of the invention and the applicant intends to be bound only by the claims appended hereto.

I claim:

1. A method of forming a flat flexible film web into a tube-shaped film having a longitudinal seam, said method including the steps of:

introducing said web to one end of a rotatable tube forming shoe at an angle with respect to a longitudinal rotational axis of said shoe, bending said film around a curved brake edge of said shoe, drawing said film across said brake edge of said shoe and guiding said film into a tubular shape while pulling said film through said shoe, blowing fluid from said edge against said film to hold said film away from said brake edge as said film is bent around said brake edge and pulled through said shoe, and including the further step of sensing changes of position of an edge of said film prior to said bending and rotating said shoe in response to the change of position of said edge to adjust film position in said shoe.

2. A method of forming a flat flexible film web into a tube-shaped film having a longitudinal seam, said method including the steps of:

introducing said web to one end of a tube forming shoe at an angle with respect to a longitudinal axis of said shoe, bending said film around a brake edge of said shoe, drawing said film across said brake edge of said shoe and guiding said film into a tubular shape while pulling said film through said shoe, sensing the position of an edge of said film, and rotating said shoe in response to sensed changes in the position of said film edge to control the orientation of film in said shoe.

3. A method as in claim 2, including the further step of sensing changes of position of an edge of said film prior to said bending, and rotating said shoe in response to the change of position of said edge to correct film position in said shoe, and to maintain a predetermined film edge orientation in said shoe.

4. In a tube-shaped forming shoe for forming flat webs into tubular form, said shoe having a brake edge over which said web is drawn, the improvement comprising means for sensing the position of said web with respect to said shoe and means operably connected to said sensing means for rotating said shoe about a longitudinal axis thereof, in response to changes of position of said web, for adjusting the position of said web with respect to said shoe.

5. Apparatus as in claim 4, wherein said means for rotating said shoe comprises a collar attached around said shoe, means rotationally mounting said collar, and an arm connected to said collar for rotating said shoe.

6. Apparatus as in claim 5, including motive means controlled by said sensing means and attached to said arm, said motive means responsive to said sensing means for rotating said shoe upon change of position of said web edge.

7. Apparatus as in claim 6, wherein said motive means is adjustably connected to said arm to vary the amount of rotation of said shoe for similar changes in the position of said web edge.

8. Apparatus as in claim 4, wherein said means for sensing the position of said web includes means for sensing changes of position of an edge of said web and wherein said means operably connected to said sensing means for rotating said shoe responsive to changes in the position of said web edge is operable to rotate said shoe to control the orientation of said film when it is drawn through said shoe.

* * * * *